United States Patent [19]

Göller

[11] Patent Number: 4,910,882

[45] Date of Patent: Mar. 27, 1990

[54] SOLE FOR A SHOE WITH AN AERATING AND MASSAGING INSOLE

[76] Inventor: Gerd Göller, Beckenhofer Strasse 25, D-6780 Pirmasens, Fed. Rep. of Germany

[21] Appl. No.: 189,990

[22] Filed: May 4, 1988

[30] Foreign Application Priority Data

May 4, 1987 [DE] Fed. Rep. of Germany ..... 3714795

[51] Int. Cl.[4] ..... A43B 7/06; A43B 13/40

[52] U.S. Cl. ..... 36/3 B; 36/44; 128/582; 128/588

[58] Field of Search ..... 36/43, 44, 3 B, 3 R; 128/582, 588, 594, 25 B

[56] References Cited

U.S. PATENT DOCUMENTS

| | | | |
|---|---|---|---|
| 861,846 | 7/1907 | Henricks | 36/3 B |
| 1,125,134 | 1/1915 | Lee | 128/594 X |
| 2,734,286 | 2/1956 | Anson | 128/582 |
| 2,868,191 | 1/1959 | Juhasz | 128/25 B |
| 3,595,244 | 7/1971 | Kugler | 128/582 |
| 4,003,372 | 1/1977 | Willoby | 128/25 B |
| 4,075,772 | 2/1978 | Sicurella | 36/43 |
| 4,095,353 | 6/1978 | Foldes . | |
| 4,215,492 | 8/1980 | Sandmeier . | |
| 4,224,746 | 9/1980 | Kim . | |
| 4,364,186 | 12/1982 | Fukuoka . | |
| 4,598,484 | 7/1986 | Ma | 36/3 R |
| 4,647,203 | 6/1987 | Goller | 36/44 |
| 4,685,224 | 8/1987 | Anger | 36/43 |

FOREIGN PATENT DOCUMENTS

| | | | |
|---|---|---|---|
| 0100067 | 2/1984 | European Pat. Off. | 36/43 |
| 884017 | 7/1953 | Fed. Rep. of Germany | 36/3 B |
| 2024534 | 12/1971 | Fed. Rep. of Germany | 36/44 |
| 8437213 | 3/1985 | Fed. Rep. of Germany . | |
| 3629617 | 3/1988 | Fed. Rep. of Germany | 36/43 |
| 1410286 | 8/1965 | France | 36/3 B |
| 320287 | 8/1934 | Italy | 36/3 B |

*Primary Examiner*—James Kee Chi

*Attorney, Agent, or Firm*—Toren, McGeady & Associates

[57] ABSTRACT

A shoe sole including an outsole (5) and an insole (1). The latter includes a plurality of ribs (2) which run along the entire width of the sole, are directed transversely relative to the longitudinal direction of the sole, and are covered at the side facing the foot (10) with a perforated base layer and possibly a covering (6) of leather or fabric. The ribs (2) include a base part which has approximately the shape of a trapezoid, whose shorter base is at the bottom, so that grooves (3) occur between the ribs (2). The insole (1) is located on the upper side of an outsole (5), which upper side faces the foot. The special shape of the ribs (2) results in a reinforced reciprocal rolling effect and consequently in an improved massaging and foot aeration.

6 Claims, 2 Drawing Sheets

SOLE FOR A SHOE WITH AN AERATING AND MASSAGING INSOLE

BACKGROUND OF THE INVENTION

The invention relates to a shoe sole comprising an outsole consisting of a tough, abrasion-resistant material, a perforated insole, which faces the foot and consists of leather or fabric, and a resilient intermediate layer with ribs extending transversely relative to the longitudinal direction of the sole.

A shoe sole consisting of plastics material or rubber is known from the German Utility Model 84 37 213. This shoe sole comprises a continuous, abrasion-resistant outer layer with a formed on rim. Resiliently deformable webs are molded in the surface facing the foot in the shape of a grid. These webs slope upward toward the front, starting from the outer layer, and end with the upper edge of the sole surface. This sloping arrangement is supposed to circumvent the disadvantage that a relatively hard and abrasion-resistant material must be used for the production of the outsole, while it is better for the feet and the ankles of the shoe wearer if the shocks during walking are cushioned in a resilient and soft manner.

The substantial disadvantage of this known outsole consists in the high costs of production. An individual plastics material injection mold must be produced in each instance for every shoe size, every shoe width and for the right and left feet. Only large firms with great numbers of units and large scales can support such costs. Smaller firms, or firms which only produce shoe models in smaller numbers of units, must look for other, cheaper solutions.

Insert soles are known from US-PS 4 215 492 and US-PS 4 224 746 which can be inserted in conventionally manufactured shoes. Both insert soles comprise an upper side and a lower side of airtight material; perforations are inserted in the upper side so that the soles of the feet of the shoe wearer are aerated by means of the reciprocal rolling motion of the insert sole during walking.

The insert sole of US-PS 4 215 492 comprises additionally raised protuburances on the upper side, which are supposed to massage the front portion of the foot of the shoe wearer.

A massaging sandal is known from US-PS 4 095 253 in which the surface facing the foot is provided with a plurality of pointed protuberances. Such sandals can only be worn for a relatively short time. Since these sandals are injection molded from plastics material, high costs again arise in the production of the required injection molds.

An aerated sole for shoes is known from US-PS 4 364 186. A rigid, perforated insole is fastened on an outsole which opens upward and consists of a resilient material. The hollow space between the outsole and the insole can be reinforced with resilient, springing inserts.

Such an outsole is not usable in practice. First, it is uncomfortable for the foot always to stand on the hard insole. Slight whistling or hissing noises occur because of the pressing out of the air from the intermediate space between the insole and the outsole. However, the worst is that the outsole itself is resilient; the foot of the shoe wearer can therefore bend easily to the right or left, the walk becomes unsure, and a strained ligament is the certain result.

SUMMARY OF THE INVENTION

The present invention has the object of providing a shoe sole of the type mentioned in the beginning which has a long life, cushions shocks in a resilient manner during walking, makes it possible for the shoe wearer to walk securely and firmly, and in particular is simple and economical to produce.

This object is met in that the ribs comprise a base part and a top part, in that the cross section of the base part has approximately the form of a trapezoid, whose shorter base faces the outsole, and in that the covering is glued with the ribs.

The particular construction of the ribs makes it possible that the latter roll along, so to speak, with the rolling of the foot, wherein, however, they are additionally supported by means of the glued on covering and are guided back into their basic position. The rolling along simultaneously reinforces the massaging action on the foot and promotes the pumping out of the air located in the grooves between the ribs.

In one construction of the invention the top part of the rib has an upper side which is rounded off in cross-section in an approximately circular manner. This results in a moderate massaging action on the sole of the foot. In another construction of the invention the upper side has a triangular cross-section which results in an increased massaging action on the sole of the foot.

Particularly suitable materials for the ribs, having a higher elasticity and restoring force for producing the inner portion of the shoe are plastic and latex. Such materials include polyurethane, silicone and vulcanized rubber with a Shore hardness of 10–70.

According to a particularly preferred construction of the invention, the under construction connecting the ribs faces the foot and is perforated in the area of the grooves. In this variant, the individual ribs roll on the top part without requiring special measures. Moreover, the height of the insole, according to the invention, can be kept to a minimum.

All variants and constructions of the shoe sole, according to the invention, have the simple construction in common, sine the insole can be cut out of a prefabricated plate and can be inserted in any desired sole or shoe subsequently. The massaging action and the aerating effect can be controlled by means of varying the dimensions. The outsole can be produced from an extremely tough and long-life material without impairing comfort. The sole construction, according to the invention, is also viable for small firms and small batches. The shoe wearer notices no disadvantage relative to conventional air-cushion soles of other constructions.

BRIEF DESCRIPTION OF THE DRAWINGS

The invention, in the form of embodiment examples, is explained in more detail in the following.

DETAILED DESCRIPTION OF THE PREFERRED EMBODIMENT

Figure 1:
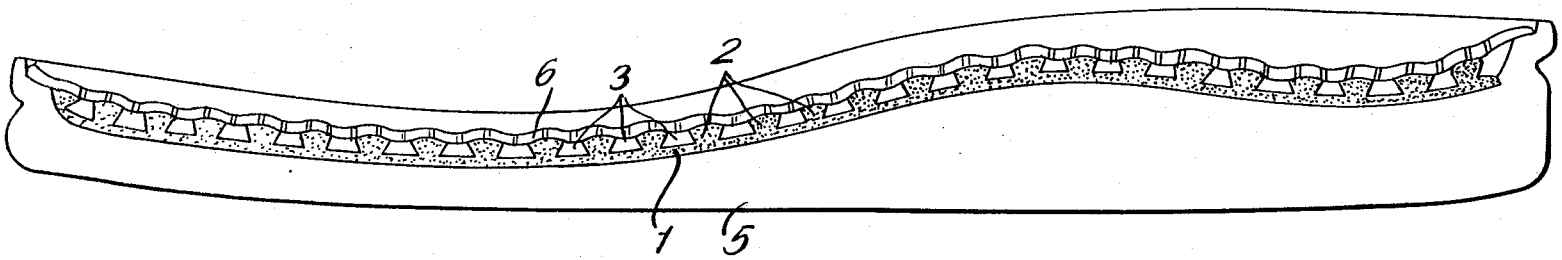
FIG. 1 shows a cross section through an outsole with inserted inner portion of the shoe.

FIG. 1 shows a cross section through an outsole 5. The outsole 5 comprises a recess which is worked in to fit, an inner portion of the shoe 1, which comprises a base plate and transversely extending ribs 2 and the grooves 3 formed between the latter, being glued into this recess, wherein the ribs 2 are covered and glued on their upper side with a perforated covering 6.

The air located in the grooves 3 can accordingly aerate the sole of the foot when the ribs 2 are pressed together and rolled to the side by means of the rolling foot. At the same time, the covering 6 supports the ribs 2 so that the latter always occupy their basic position again.

The air located in the grooves 3 in the simple embodiment form, according to FIG. 1, can flow in and out only through the perforations of the covering.

Figure 2:
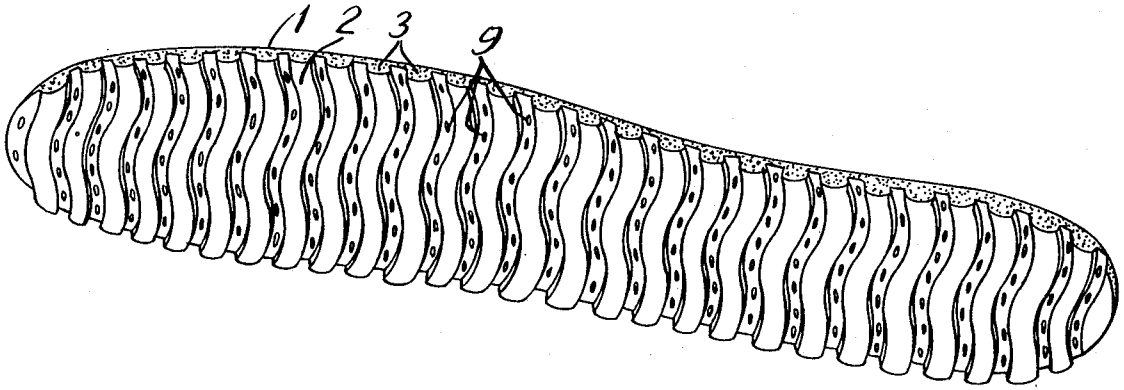
FIG. 2 shows a perspective view of a perforated, resilient intermediate layer with ribs which extend transversely relative to the longitudinal direction of the sole.
Figure 3:
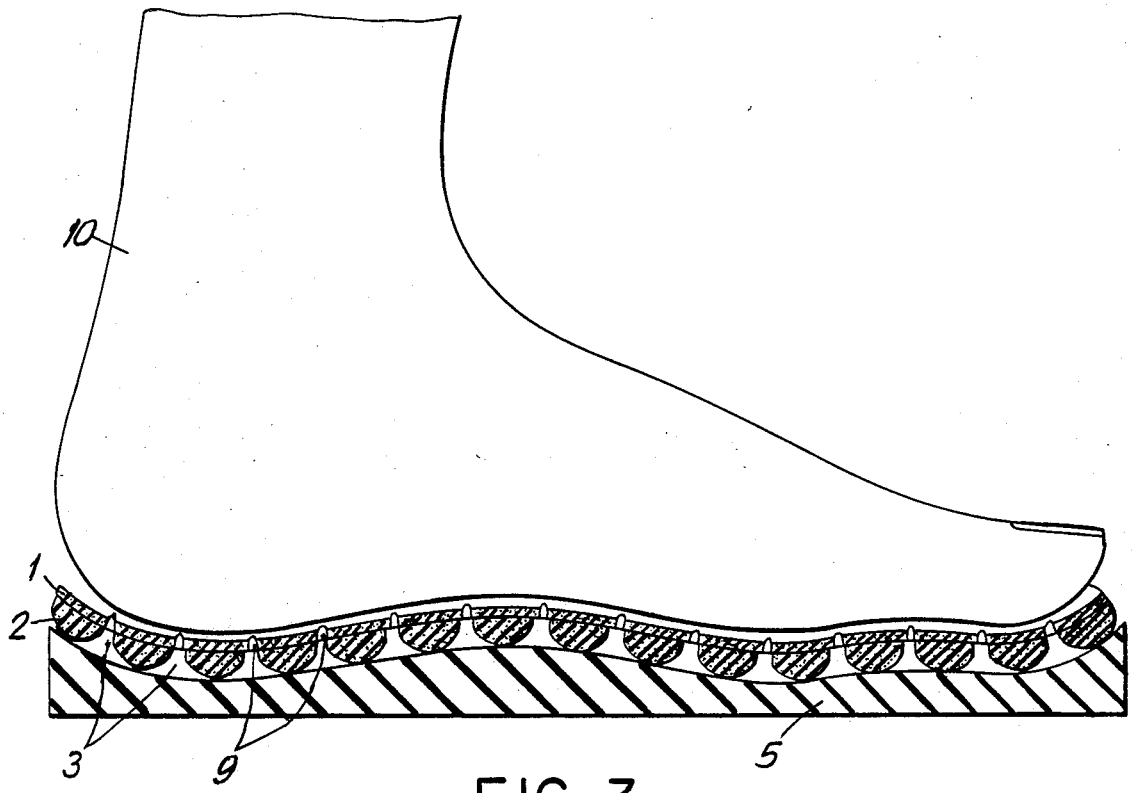
FIG. 3 shows a cross section through an outsole with inserted inner portion of the shoe.

FIG. 2 shows a perspective view of an inner portion 1 of the shoe. The ribs are curved in a wave-shaped manner and lie transversely relative to the longitudinal direction of the sole. The base plate is provided with perforations 9 in the grooves 3 between the ribs 2.

Figure 5:
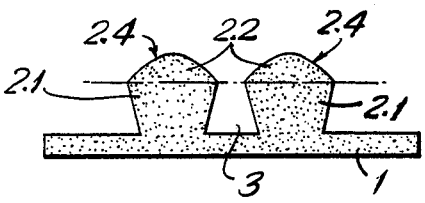
FIG. 5 shows a cross section through another inner portion of the shoe, also in an enlarged view.

FIG. 5 shows the installation of such an inner portion 1 of the shoe in an outsole 5. The tops of the ribs 2 are glued, for example, with the upper side of the outsole 5. The foot 10 stands on the perforated base surface connecting the ribs 2. This can be lined with a textile material or perforated leather if required.

In this embodiment form, the base plate has two objects. During the production and assembly of the inner portion 1 of the shoe, it holds the ribs 2 together. During use of the shoe, it serves as a supporting surface for the foot 10 and accordingly it serves simultaneously as a resiliently springing insole which transmits the shocks to the ribs 2 during walking and cushions them in a resilient manner.

Figure 4:
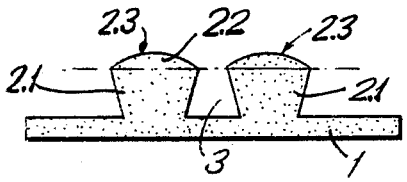
FIG. 4 shows a cross section through an inner portion of the shoe in an enlarged view.

FIGS. 4 and 5 show two embodiment forms of the ribs 2 in an enlarged view. The rib base 2.1, which has approximately the shape of a trapezoid, can be seen below the dash-dot line, wherein the shorter base is at the bottom, so that two dovetail-like grooves 3 occur between the ribs. The top part 2.2 can be seen above the base part 2.1. In the embodiment form of FIG. 4, the surface 2.3 of the top part 2.2 is rounded off in a circular manner and effects a mild to moderate massaging action. In the embodiment form of fig. 5, on the other hand, the surface 2.4 of the top part 2.2 is constructed in an approximately triangular manner, which results in a considerable massaging action.

The dimensions of the ribs 2 and their distance from one another are variable. Thus, for example, the dimensions can be greater in shoes for adults than in shoes for children. In any case, the dimensions are to be selected in such a way that the covering 6 does not enter the grooves 3. On the other hand, it must be taken into account that sufficient air remain in the grooves 3 for ensuring a sufficient aeration of the sole of the foot. Also, the massaging action is influenced by means of the number of ribs 2 and their dimensioning.

As shown in FIGS. 4 and 5, the base part 2.1 is weakest at the bottom. The rib 2 are thus not only pressed together by means of the weight of the foot 10, but simultaneously roll back and forth. This reciprocal rolling effect increases the massaging and pumping action. However, the covering 6, which is glued with the top parts 2.2 of the ribs 2, prevents an excessive reciprocal rolling.

In the embodiment form according to FIG. 4, the surface 2.3 of the top part 2.2 of the ribs 2 is curved in a flat manner. This results in a moderate massaging action on the foot.

In the embodiment form according to FIG. 5, on the other hand, the surface 2.4 of the top part 2.2 of the ribs 2 is sharply curved. This results in an intensive massaging action on the foot.

I claim:

1. A shoe sole, comprising:

an outsole (5) consisting of a tough, abrasionresistant material;

a perforated insole (6), which faces a foot (10) and consists of leather or fabric; and a resilient intermediate layer with ribs (2) which extend transversely relative to the longitudinal direction (4) of the sole so as to roll along with a rolling action of the foot, the ribs (2) comprising a base part (2.1) and a top part (2.2), the base part (2.1) having an approximately trapezoidal crosssection with a shorter base facing the outsole (5), the perforated insole (6) being glued with the ribs (2) so as to guide the ribs back to an unweighted position.

2. (Shoe) A shoe sole according to claim 1, wherein the top part has an upper side which is rounded off in cross section in an approximately circular manner.

3. A shoe sole according to claim 1, wherein the top part (2.2) has an upper side which is approximately triangular in cross section.

4. A shoe sole according to claim 1, wherein the ribs (2) comprise one of plastics material and latex material having a high elasticity and restoring force.

5. A shoe sole according to claim 4, wherein the ribs (2) consist of one of polyurethane, silicone and vulcanized rubber with a Shore hardness of 10–70.

6. A shoe sole according to claim 1, and further comprising an under construction (1) connecting the ribs provided so as to face the foot (10), the under construction being perforated in the area of grooves (3) separating the ribs.

* * * * *